United States Patent [19]

Studebaker

[11] 4,231,700

[45] Nov. 4, 1980

[54] METHOD AND APPARATUS FOR LASER BEAM CONTROL OF BACKHOE DIGGING DEPTH

[75] Inventor: Robert H. Studebaker, Dayton, Ohio

[73] Assignee: Spectra-Physics, Inc., Mountain View, Calif.

[21] Appl. No.: 28,178

[22] Filed: Apr. 9, 1979

[51] Int. Cl.[3] ..... E02F 9/20

[52] U.S. Cl. ..... 414/700; 37/DIG. 1; 414/786

[58] Field of Search ..... 414/694, 698, 700, 786; 212/39 MS; 37/DIG. 1, DIG. 19; 172/4, 4.5

[56] References Cited

U.S. PATENT DOCUMENTS

| | | | |
|---|---|---|---|
| 3,395,816 | 8/1968 | Hodges et al. | 414/694 |
| 3,550,794 | 12/1970 | Suverkrop | 414/694 |
| 3,584,751 | 6/1971 | Bellart | 414/694 |
| 3,997,071 | 12/1976 | Teach | 212/39 MS |
| 4,034,490 | 7/1977 | Teach | 37/DIG. 1 |
| 4,050,171 | 9/1977 | Teach | 37/DIG. 1 |
| 4,107,859 | 8/1978 | Keith | 37/DIG. 1 |
| 4,129,224 | 12/1978 | Teach | 414/698 |

*Primary Examiner*—Allen N. Knowles

*Attorney, Agent, or Firm*—Wilson, Fraser, Barker & Clemens

[57] ABSTRACT

This invention provides a method and apparatus for controlling the digging depth of the bucket of a backhoe or an excavator so as to move the digging edge of the backhoe bucket in a plane parallel to an overhead reference plane defined by a rotating laser beam. The detecting means for the laser beam is mounted on a medial portion of the downreach boom and the control of the position of the bucket is accomplished by moving the outreach boom of the backhoe relative to the supporting platform so as to maintain the detecting means on the downreach boom in a fixed relationship with respect to the reference plane defined by the rotating laser beam.

4 Claims, 2 Drawing Figures

METHOD AND APPARATUS FOR LASER BEAM CONTROL OF BACKHOE DIGGING DEPTH

BACKGROUND OF THE INVENTION

In the past ten years, there has been a widespread utilization of a rotating laser beam as an overhead reference plane to control the operation of earth working implements such as graders, scrapers and trenchers. One of the most common earth movers is the backhoe, which is available either as a self-contained unit or as an attachment for the rear end of a tractor, which may have a loader mounted on its front end. The popularity of such units with many small contractors is such that the units are often employed for specific excavations for which the backhoe is normally not capable of producing acceptable work. For example, if a trench is required for drainage tile with the trench bottom having a prescribed pitch relative to the horizontal, the small contractor will attempt to use his backhoe to dig such trench and this is a practical impossibility for, as is well known, the normal digging stroke of a backhoe involves an arcuate movement of the bucket throughout the stroke and to convert that arcuate movement to a linear movement parallel to a prescribed plane is a matter that is beyond the skill of the operator manipulating the various hydraulic cylinders that control the three primary pivoted elements of the backhoe.

There is, therefore, a definite need for a method and apparatus for controlling the operation of a backhoe to cause the digging edge of the bucket to move in a linear path parallel to a prescribed reference plane. While a very effective overhead reference plane may be provided by a rotating laser beam, there has not heretofore been available any concept or apparatus for automatically controlling the operation of a backhoe by such reference plane of laser energy.

In U.S. Pat. No. 3,997,071 to Teach, there is disclosed an apparatus for indicating the effective depth of the teeth of the bucket of the backhoe through the utilization of an overhead laser beam reference plane, but this apparatus in no manner provides for the automatic control of the path of movement of the bucket of the backhoe. In U.S. Pat. No. 4,129,224 to Teach there is disclosed an arrangement for controlling the path of movement of the bucket of the backhoe but this control is effected by maintaining a trigonometric relationship between the three primary angles involved in the operation of a backhoe, namely the angle between the outreach boom and the horizontal, the angle between the outreach boom and the downreach boom, and the angle between the downreach boom and the bucket which is pivotally mounted to the end thereof. While this apparatus discloses an overhead laser beam reference plane, it is utilized solely for calculating and indicating the depth of the digging teeth of the bucket, and not for actually controlling the movement of the bucket.

The apparatus disclosed in the aforementioned Teach U.S. Pat. No. 4,129,224 requires the utilization of angular transducers at each of the three primary pivot points of the backhoe, plus a micro processor for effecting the required trigonometric calculations to develop the control signals for maintaining the digging teeth of the backhoe moving along a desired plane.

OBJECTS OF THE INVENTION

There is, accordingly, a need for an apparatus for automatically controlling the path of movement of the digging bucket of a backhoe which does not require the employment of angular transducers and micro processors which constitute relatively delicate equipment to be mounted on an implement subject to all of the rough movements and adverse atmospheric conditions which are characteristic of the operation of backhoes. Accordingly, it is an object of this invention to provide an improved apparatus for controlling the digging path of the backhoe to move in a plane parallel to the plane of an overhead reference plane defined by a rotating laser beam.

A particular object of this invention is to provide an improved method and apparatus for controlling the operation of a backhoe by causing the digging edge of the bucket to move in a desired plane, parallel to that defined by a rotating overhead laser beam reference plane, through the employment of a laser beam receiver mounted on the medial portion of the downreach boom of the backhoe bucket. In accordance with the method of this invention, the angle between the downreach boom and the outreach boom is manually controlled by the operator and the vertical angular position of the outreach boom is electronically controlled in accordance with signals generated by the photocell receiver mounted on the downreach boom to cause the bucket to move in a plane parallel to that of an overhead laser beam reference plane.

Further objects and advantages of this invention will be apparent to those skilled in the art from the following detailed description thereof taken in conjunction with the annexed sheet of drawings.

DESCRIPTION OF PREFERRED EMBODIMENT

Figure 1:
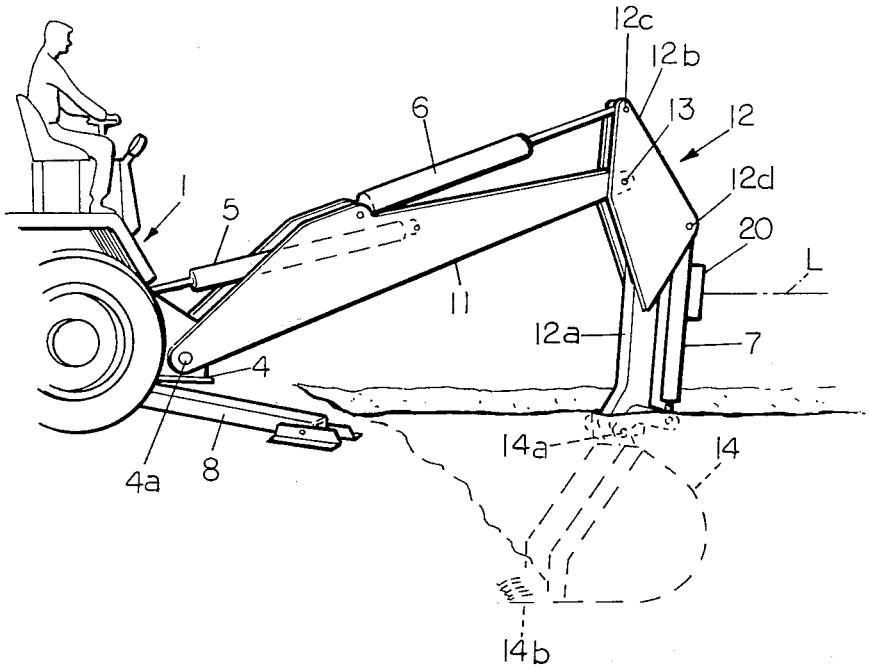
FIG. 1 is a schematic elevational view of a backhoe incorporating this invention.

As is well known in the backhoe art, such backhoes comprise an outreach boom 11 formed by two spaced triangular plate members suitably secured together by weldments to form a rigid truss element. The forward end of outreach boom 11 is appropriately secured to a horizontal transverse shaft 4*a* journalled by a mounting platform or bracket 4. Bracket 4 is pivotally mounted to a vehicle 1 for horizontal swinging movements by conventional means (not shown). Hydraulic cylinder 5 operates between bracket 4 and the outreach boom 11 to control the vertical pivotal position of said outreach boom 11 relative to the vehicle. A pair of laterally projecting stabilizing pads 8 are also attached to vehicle 1 in conventional fashion.

Of course, the principles of this invention are equally applicable to a self-contained, self-propelled backhoe wherein the outreach boom 11 is supported by a platform which is horizontally rotatable on the self-propelled vehicle.

At the free end of the outreach boom 11, a downreach boom 12 comprises a main structural frame element 12*a* to which a pair of generally triangular plates 12*b* are respectively secured by welding in opposed relationship. The plates 12*b* are traversed by the mounting pin 13 to secure boom 12 to the end of boom 11. Plates 12*b* also support a pivotal mounting pin 12*c* which receives the end of a cylinder unit 6 which operates between the outreach boom 11 and the downreach boom 12 to control the relative angular positions of said booms. A third pivot mounting pin 12*d* traversing plates 12*b* provides a pivot mounting for a cylinder unit 7 which controls the pivotal position of a digging bucket 14 which is pivotally mounted to the free end of the downreach boom 12 as by pivot pin 14*a*. Bucket 14 is of conventional configuration and has a digging blade or teeth 14*b* at its extreme lower edge. Obviously, it is the vertical position or depth of the digging blade or teeth 14*b* that determines the effective digging depth of the bucket 14.

Each of the cylinders 5, 6 and 7 respectively controls the vertical angular position of the outreach boom 11 relative to the vehicle, the pivotal position of the downreach boom 12 relative to the outreach boom 11, and the position of the bucket 14 with respect to the end of the downreach boom 12. Each such cylinder is normally manually controlled by conventional individual hydraulic valve controls positioned immediately adjacent the operator's seat on the vehicle 1. By varying the relative angle of the outreach boom 11 with respect to the vehicle, the digging bucket may be moved to a digging position beneath the ground. The path of the digging bucket through the ground is obviously controlled by the operator by making the appropriate variations of the relative angles between the outreach boom 11, the downreach boom 12 and the digging bucket 14.

Figure 2:
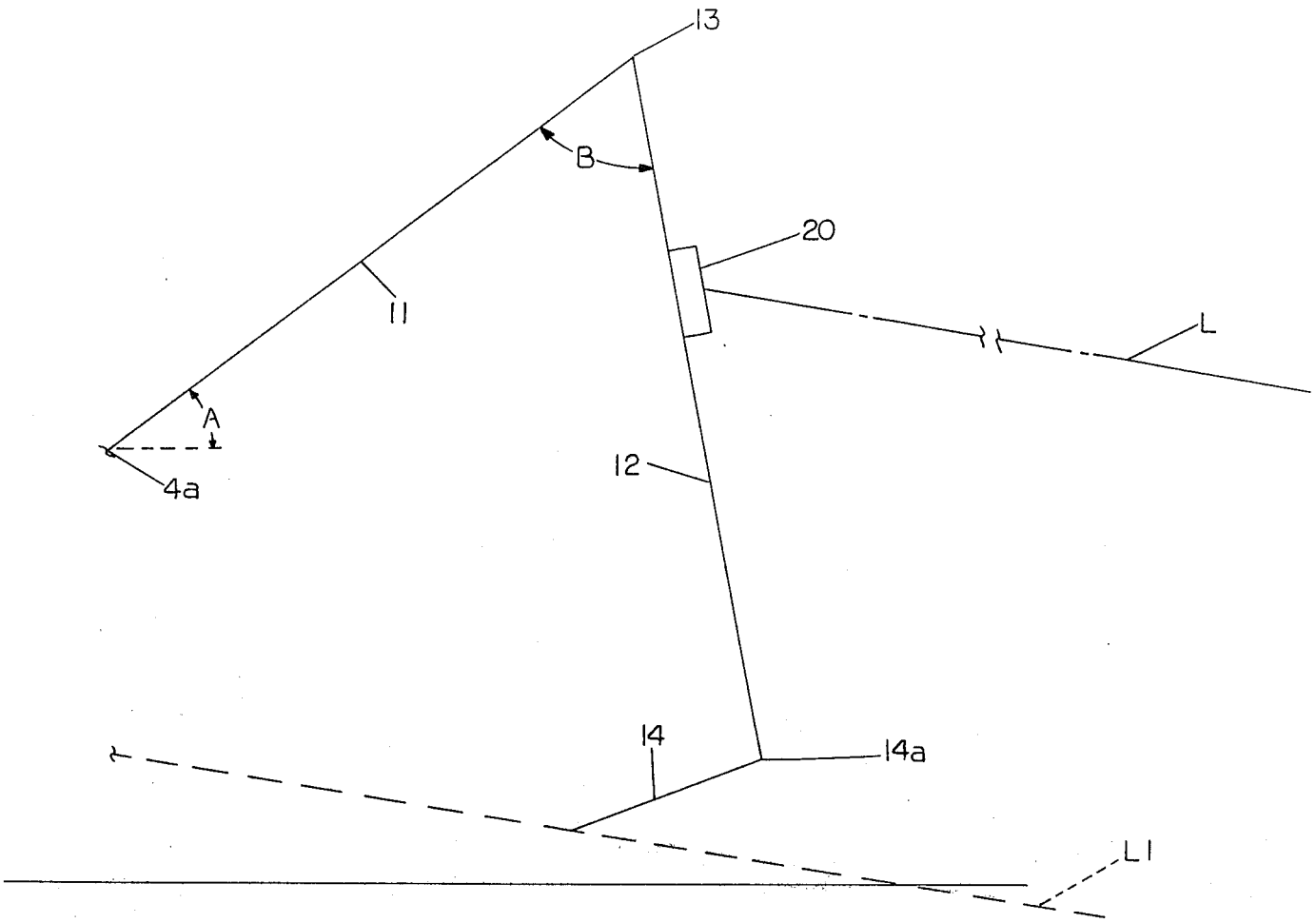
FIG. 2 is a geometric diagram of the movable elements of a backhoe.

The various pivoted elements of the backhoe heretofore described are schematically illustrated by the geometric drawing shown in FIG. 2. In the normal operation of the backhoe, most of the digging stroke is accomplished by the operator varying the angle B between the outreach boom 11 and the downreach boom 12. As this angle is reduced to effect the digging stroke, the digging edge 14*b* of the bucket is normally held in the same relative angle of attack by its cylinder 7 and the pivotal movements of the bucket 14 relative to the downreach boom 12 primarily arise in the lifting of the bucket and its contents out of the excavation at the end of the digging stroke and in then dumping the contents of the bucket.

In any event, even with experienced operators, the effective path of the digging edge 14*b* of the bucket is not linear but rather a series of arcuate movements because it is relatively impossible for the operator to exactly control the angle A between the outreach boom 11 and the platform 4 so as to cause the digging edge of the bucket to move linearly in a plane parallel to the desired slope of the bottom of the excavation.

In accordance with this invention, an overhead reference plane of laser energy is defined by a laser beam L which is periodically swept over the working area. The apparatus for generating such rotating laser beam may be that disclosed in my prior U.S. Pat. No. 3,588,249. A photocell detector unit 20 capable of generating signals when impinged by the rotating laser beam, is mounted on the downreach boom 12, preferably in a position on the outer side of the medial portion of such boom, such as on cylinder 7, so that the detector unit 20 is relatively protected from inadvertent damaging engagement with other objects during the excavating process. Of course, the position of the detecting unit 20 should be sufficiently high relative to the ground so as to insure that it will contact the laser beam L. Furthermore, the vertical extent of the detecting unit 20 should be such as to maintain the impingement of the detector unit 20 by the laser beam L throughout a normal digging stroke.

Conventional circuitry means (not shown) of the type disclosed in my prior patent, U.S. Pat. No. 3,494,426 is provided for converting the electrical signals generated by the laser beam detecting unit 20 into hydraulic signal which are applied to the hydraulic control circuit of the cylinder 5 which controls the vertical position of the outreach boom 11 relative to the platform 4. The cylinder 5 is automatically controlled to move boom 11 so as to maintain the central portion of the detecting unit 20 constantly in engagement with the rotating laser beam L. It necessarily follows, therefore, that if the plane of the rotating laser beam L is tilted relative to the horizontal, as shown in FIG. 2, then the detector unit 20 will move along a similarly tilted path parallel to the laser energy reference plane.

Throughout the digging stroke, the bucket 14 is maintained at a fixed angular relationship with respect to the downreach boom 12 by its cylinder 7 and therefore, the digging teeth or digging edge 14*b* of the bucket also moves in a plane parallel to the laser beam reference plane, indicated by line L1 in FIG. 2.

If it is desired to reduce the expense of the laser controlled backhoe, the control circuitry may be substantially simplified by merely providing indicating lights which tell the operator when the outreach boom 12 must be raised or lowered while the digging stroke progresses. This method of operation will not, however, provide the preciseness of control of the slope of the bottom of the excavation as is possible with the fully automated control arrangement heretofore described.

In this manner, a backhoe may be employed to accurately dig a sloped trench for the mounting of drainage pipe wherein the bottom of the trench must be finished to a prescribed slope within an accuracy of one inch or less. Such accuracy is readily possible with the method and apparatus of this invention and hence greatly enhances the utility and capability of any backhoe.

Modifications of this invention will be readily apparent to those skilled in the art and it is intended that the scope of the invention be determined solely by the appended claims.

I claim:

1. In a backhoe having a platform movable about a vertical axis, an outreach boom pivotally mounted on the platform for movement about a horizontal axis, a downreach boom having one end horizontally pivotally mounted to the free end of the outreach boom, a digging bucket pivotally mounted to the other end of the downreach boom, and separate power means for controlling the vertical pivotal movements respectively of the outreach boom relative to the platform, of the downreach relative to the outreach boom, and of the bucket relative to the downreach boom, the improvements comprising:

1. means for establishing an above ground reference plane of laser energy;
2. photocell means mounted on said downreach boom and constructed and arranged to intercept said plane of laser energy throughout the digging stroke of the backhoe;
3. means responsive to the signals generated by said photocell means for varying the vertical pivotal angle of said outreach boom relative to said platform to maintain said photocell means on said downreach boom at a predetermined position relative to said reference plane throughout the digging stroke of the backhoe, and 4. means for maintaining the bucket in a fixed position throughout the digging stroke of said backhoe, whereby the digging edge of said bucket moves in a plane parallel to said overhead reference plane of laser energy.

2. The improvements defined in claim 1 wherein said photocell means is mounted on the outer side of the downreach boom and has sufficient vertical extent to be contacted by said reference plane of laser energy throughout the normal digging stroke of the downreach boom.

3. The method of controlling the operation of a backhoe having an outreach boom pivotally mounted on a platform for movement in a vertical plane, a downreach boom pivotally mounted to the free end of the outreach boom for movement in a vertical plane, a digging bucket pivotally mounted to the other end of the downreach boom for movement in a vertical plane, and separate power means for respectively effecting said pivotal movements, comprising the steps of:

1. creating an above ground reference plane of laser energy;
2. detecting said plane of laser energy throughout the digging stroke of the backhoe by a detecting unit mounted on said downreach boom;
3. manually controlling the power means to pivot the downreach boom relative to the outreach boom through a digging stroke;
4. controlling the angle of said outreach boom relative to said platform to maintain the detecting unit on said downreach boom at a fixed position relative to said overhead reference plane throughout the digging stroke of the backhoe, and
5. maintaining the digging bucket in a fixed angular relationship to the downreach boom throughout the digging stroke of the backhoe, whereby the digging edge of the bucket moves in a plane parallel to the overhead reference plane of laser energy.

4. The method defined in claim 3 wherein step 4 is performed automatically.

* * * * *

UNITED STATES PATENT AND TRADEMARK OFFICE

CERTIFICATE OF CORRECTION

PATENT NO. : 4,231,700

DATED : November 4, 1980

INVENTOR(S) : Robert H. Studebaker

It is certified that error appears in the above-identified patent and that said Letters Patent are hereby corrected as shown below:

In column 4, line 53 please add the word --boom-- after the word "downreach".

Signed and Sealed this

*Third* Day of *February 1981*

[SEAL]

*Attest:*

RENE D. TEGTMEYER

*Attesting Officer*

*Acting Commissioner of Patents and Trademarks*